United States Patent [19]

Gulbrantson

[11] 4,067,004

[45] Jan. 3, 1978

[54] REMOTE PERSONNEL STATION ALARM SYSTEM

[75] Inventor: William Gulbrantson, Portland, Oreg.

[73] Assignee: FMC Corporation, San Jose, Calif.

[21] Appl. No.: 711,950

[22] Filed: Aug. 5, 1976

[51] Int. Cl.[2] ..... G08B 17/10

[52] U.S. Cl. ..... 340/237 R; 128/142.3; 340/213.1; 340/214

[58] Field of Search ..... 340/237 R, 213.1, 213.2, 340/214, 412, 416, 151; 128/142 R, 142.3, 142.2, 142.7, DIG. 29

[56] References Cited

U.S. PATENT DOCUMENTS

| | | | |
|---|---|---|---|
| 1,561,086 | 11/1925 | Korjibski | 128/142.3 |
| 2,049,987 | 8/1936 | Willenborg | 340/237 R |
| 2,102,457 | 12/1937 | Gandy | 340/237 R |
| 2,533,339 | 12/1950 | Willenborg | 340/237 R |
| 2,639,418 | 5/1953 | Sundstrom et al. | 340/214 |
| 3,452,345 | 6/1969 | Kinsey | 340/214 UX |
| 3,493,467 | 2/1970 | Ressler | 340/416 |
| 3,550,111 | 12/1970 | Ervin | 340/416 X |

*Primary Examiner*—John W. Caldwell
*Assistant Examiner*—Daniel Myer
*Attorney, Agent, or Firm*—C. E. Tripp

[57] ABSTRACT

A carbon monoxide Monitoring System includes a control panel and remote alarm stations. The control panel is associated with a carbon monoxide monitoring unit, an emergency AC power pack and an alarm system. Each remote alarm station includes a visual-audio alarm system and a distress signal system. The carbon monoxide monitoring unit continuously samples the personnel air supply and if the CO reaches a pre-set concentration, it will provide a primary audio-visual alarm signal to a panel alarm for the control panel operator and to each individual remote alarm station, thereby giving warning of an excess of carbon monoxide gas in the air supply to the control panel operator and to the remote workers. In addition, if a worker at any remote station is in distress, he actuates his distress signal system which energizes the control panel alarm system. The control panel operator is alerted and takes whatever action is required. The AC emergency power pack will automatically provide AC power to the CO monitoring unit and to the remote stations, in the event the normal AC power supply is interrupted. This allows for fail-safe operation of the CO monitoring system in an emergency.

6 Claims, 11 Drawing Figures

I. REMOTE UNIT AT PANEL
A. NORMAL

I. REMOTE UNIT AT PANEL
B. STATION TEST

I. REMOTE UNIT AT PANEL
C. STATION TEST, RESET AT REMOTE UNIT

I. REMOTE UNIT AT PANEL
D. CO ALARM TEST

I. REMOTE UNIT AT PANEL
E. CO ALARM TEST, RESET AT REMOTE UNIT

II. REMOTE UNIT BELOW
A. NORMAL (SAME AS FIG. 4)
B. CO ALARM (FIG. 9)

II. REMOTE UNIT BELOW
C. REMOTE DISTRESS SIGNAL

II. REMOTE UNIT BELOW
D. REMOTE UNIT TEST

REMOTE PERSONNEL STATION ALARM SYSTEM

SUMMARY OF THE INVENTION

The present invention will be described in connection with a ship building or repair installation. It involves the insertion of a special deck panel system between a commercial CO alarm unit that provides a primary gas alarm signal plus a commercial remote alarm unit at each remote station. The invention also includes the addition of a special distress signal switch to each remote alarm unit of a multiple station system. The units at each remote station are connected to the carbon monoxide monitor unit through a panel that includes testing switches and a secondary alarm assembly that insures reliability in operation and provides for certain test procedures before the system is put into operation. The system makes it possible for a worker at each remote station to send a distress signal to the panel operator, which signal also indicates the remote station involved so that the panel operator can proceed to the remote station and take necessary corrective action. As mentioned, the system of the present invention will be described as applied to a shipboard installation, but it can be employed in other hazardous environments, such as mines, etc.

In putting the system into operation, preliminary or reliability tests are first conducted with each remote station unit above deck and connected to the panel assembly.

One of the above preliminary or reliability tests is a "station test" . This is an individual test for each unit and is formed by closing a panel "station test" button for that unit. This test checks the operation of a corresponding station indicator light at the panel and of a main alarm relay in the remote alarm unit. When the panel station test button for a given remote unit is depressed, a CO alarm light of the corresponding remote unit is lit through a flasher, the remote unit alarm bell rings and a normal on power light for the remote unit is turned off. As mentioned, the corresponding station indicator light at the panel is also turned on.

While the panel operator continues to depress the "station test" switch button at the panel for a given remote unit that is above deck, an operator at the remote unit turns a switch on that unit to a reset position which checks the energization of a relay in the remote unit that by-passes the flasher and silences the warning bell. When the panel operator releases the panel station test switch button for a given remote unit, the conditions of the remote unit return to normal with the CO alarm unit and the tester light units off and the normal power light on. These "station tests" indicate that the wiring of each individual unit is correct and that critical relays are operating.

The system of the present invention also provides for simulating a primary carbon monoxide alarm unit signal and insuring that all of the remote station units (while they are above deck) properly respond to a CO alarm signal. To make such a test, a panel "alarm test" button is depressed which provides a signal through the panel to the various remote alarm units that corresponds to the primary alarm signal they would receive when an excess of carbon monoxide gas is detected by the monitor unit. The aforesaid operation of the panel "alarm test" switch energizes the secondary alarm assembly at the panel, namely the CO alarm light and the horn at the panel as well as operating the same CO alarm contacts that are operated by the CO monitor unit when gas is detected. The secondary alarm signal provided by the "alarm test" switch at the panel causes the red CO alarm light of each remote unit to turn on through the flasher and darkens the normally on green power light of each remote unit. This alarm test, which is performed before the units are taken below to their respective remote stations, coupled with the previously mentioned station tests, insure that the system will be operable when the remote units are mounted at their respective remote station and re-plugged into the panel.

While the panel alarm switch is still operated to provide a simulated CO alarm test for all units above deck, an operator for each of the remote units can turn a normally neutral "reset" test switch to the reset position. If certain relays in the remote unit are properly operating this causes the CO alarm light to shift from its flashing condition to a steady condition and silences the alarm bell on the remote alarm unit.

During operation, and in case a worker at a remote station is in distress, needs assistance or wishes something checked by above-deck personnel, the remote worker can turn an "acknowledge-signal" switch at this remote alarm unit to the "signal" position. This lights up the station indicator light at the panel corresponding to the signaling remote unit and also lights the alarm light and energizes the horn at the panel. This alerts the panel operator of need for corrective action and indicates which remote station needs that action. The aforesaid panel station indicator and alarm signals cannot be de-energized unless a person at the remote station resets the "acknowledge-signal" switch to the "acknowledge" condition, thereby assuring that a remote distress signal will result in immediate investigation and corrective action.

The manner in which the panel test system and remote signal system of the present invention enhances reliability and safety of the installation will be apparent from the following detailed position of a preferred embodiment of the invention.

DETAILED DESCRIPTION OF THE DRAWINGS

GENERAL ARRANGEMENT OF THE SYSTEM

Figure 1:
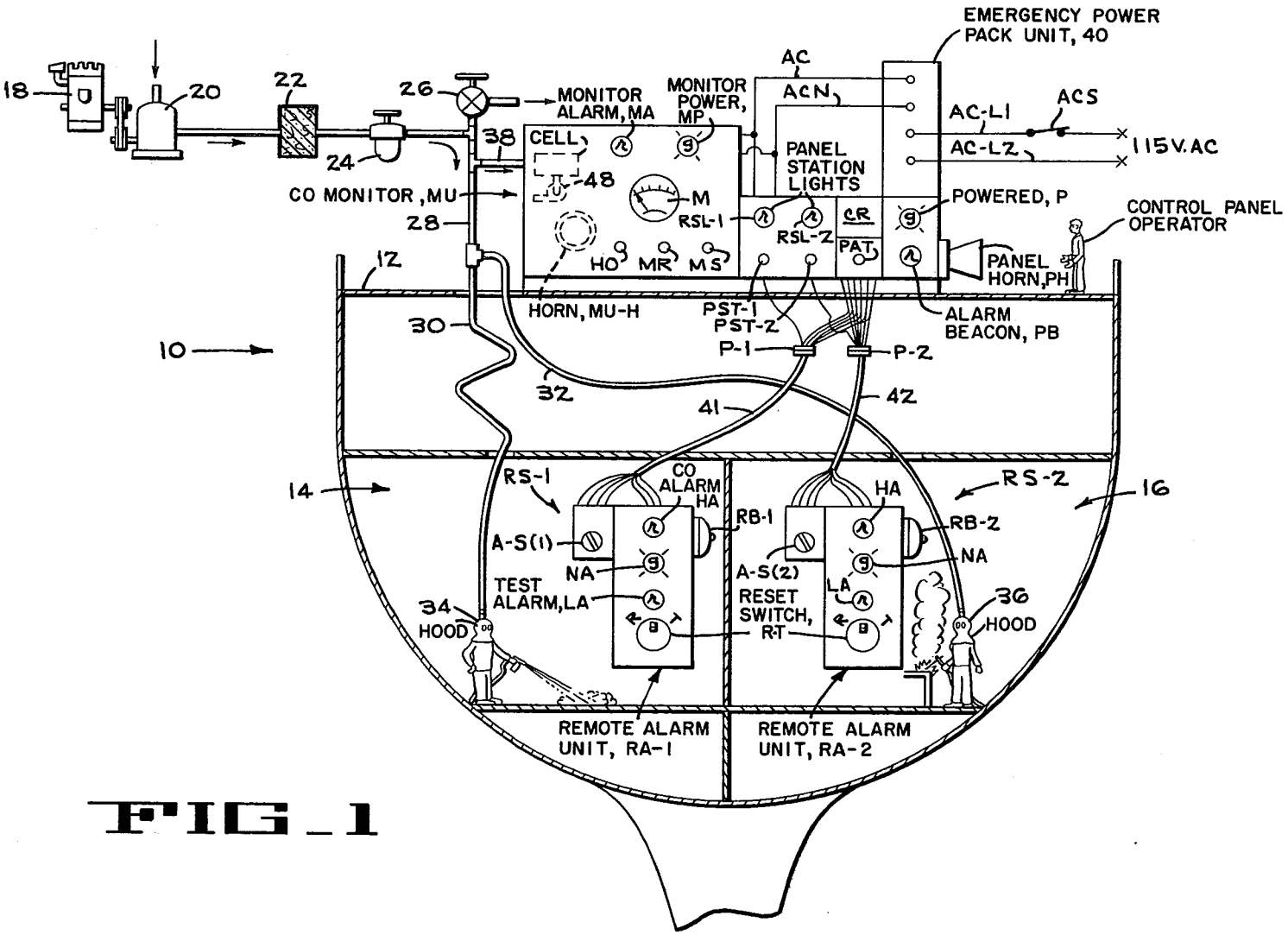
FIG. 1 is a schematic diagram showing the installation of the present invention as employed for use when work is done below, aboard a ship.

FIG. 1 is a diagramatic arrangement showing the disposition of the basic parts of the system of the present invention as applied to a shipboard installation which provides a respiratory system for workers at remote stations below deck. Although only two remote stations are indicated in the figure it is to be understood that the CO alarm and panel units of the present invention can be connected to a large number of remote stations.

The ship, indicated diagramatically at 10, is shown in section and has an upper deck 12 with two remote stations such as compartments or holds 14,16. Air must be supplied to the remote stations, both for the utilization of air tools and for respiratory masks or hoods worn by the remote workers. Thus, an engine 18 drives one or more air compressors 20 which deliver compressed air through a filter and drier unit 22, and a pressure regulator 24. The amount of air delivered to the respiratory system can be controlled by a bleed valve 26, the remainder supplying air for tools (not shown). The respiratory air is directed through a main line 28 which has a branch line 30 for the compartment 14 and a branch line 32 for the compartment 16. Respiratory air is delivered to a mask or hood 34 for the operator in the compartment 14 and a similar device 36 for the operator in the compartment 16.

A sample of the air being fed to the respiratory system is bled off from the line 28 by a sample line 38 and enters the carbon monoxide measuring cell of a CO monitoring unit MU disposed above deck.

CO Monitor Unit

In the embodiment of the invention being disclosed the CO monitor MU is a "MSA Carbon Monoxide Alarm 107" manufactured by the MSA Instrument Division, Pittsburgh, Pa. Within the CO monitor unit, which provides the primary gas alarm signal, the air sample from line 38 enters a chemical cell which forms part of a Wheatstone bridge circuit and which measures the percentage of CO in the air supply, the measurement being indicated on a meter M in the bridge circuit. The CO monitor unit also has a red "monitor alarm" light MA and a monitor unit alarm horn MU-H. Also included is a green monitor power light MP, and off-on power switch MS, a horn silencing switch HO and a reset switch MR. The monitor unit also includes a relay (not shown in FIG. 1) which operates various contacts when an excess of CO is deleted in the air sample.

Panel

Also, above deck and connected between the CO monitor unit MU and each remote alarm unit RA-1, RA-2, etc. is a panel assembly. The latter includes red panel station indicator lights RSL-1, RS-2, etc. and panel "station test" switches PST-1, PST-2, etc. The panel further includes a control relay CR that is controlled by the aforesaid monitor unit CO alarm relay (not shown). A panel "alarm test" switch PAT is also provided. At the panel is a green power indicator light P, a red CO alarm beacon light PB and a panel CO alarm horn PH. During operation, at least one control panel operator is always on duty at the panel.

Power Supply

The power supply is from a 115 volt AC line through a main switch ACS and lines AC-L1 and AC-L1 which lines connect to an emergency power pack unit 40. The purpose of the emergency power pack is to supply power to the system for a period of 90 minutes in case the external power supply fails. Emergency power packs of this type are known in the art and a unit suitable for the present invention is a STACK PAC AC Power Pack manufactured by the Siltron Illumination Inc., Gardena, Cal. The power from the emergency power pack is conducted by lines AC and ACN to the CO monitor power unit MU and to the panel assembly.

Remote Alarm Units

The remote alarm unit RA-1 and its associated acknowledge-signal switch A-S (1), located at the remote station RS-1 in the hold 14, are connected to the panel by a cable 41 and a multi-terminal plug P-1. The corresponding alarm unit RA-2 in the remote station RS-2 in the old 16 is connected to the panel by a cable 42 and a multi-connection plug P-2. Of course, if additional remote stations are provided, additional cables and plugs are also provided.

As mentioned, the units at the remote stations, such as station RS-1, include a remote alarm unit RA-1 and an "acknowledge-signal" switch A-S (1).

In the embodiment of the invention being disclosed and as will be described in detail, each of the remote alarm units, such as the unit RA-1, is available to the trade as a Crouse-Hinds Visualarm Model M2, EKPU 43-3, manufactured by the Crouse-Hinds Company of Syracuse, N.Y.

These units include a red upper CO alarm light HA, an intermediate green, normally on power light NA and a lower red test alarm light LA. Each unit also includes a reset-test switch RT which has a reset and test position which is normally in a neutral position, so that neither the reset nor the test circuits are energized. Each "acknowledge-signal" switch A-S (1), A-S (2), etc. associated with each remote alarm unit is a separate piece of equipment not supplied with the alarm unit. Each alarm unit also has an audio warning signal device such as the bell RB (1) in the case of the remote unit RA-1 which, in case of an alarm and during some test rings at the same time that the remote unit CO alarm light HA lights up.

Basic Wiring Diagram of the System

Figure 2:
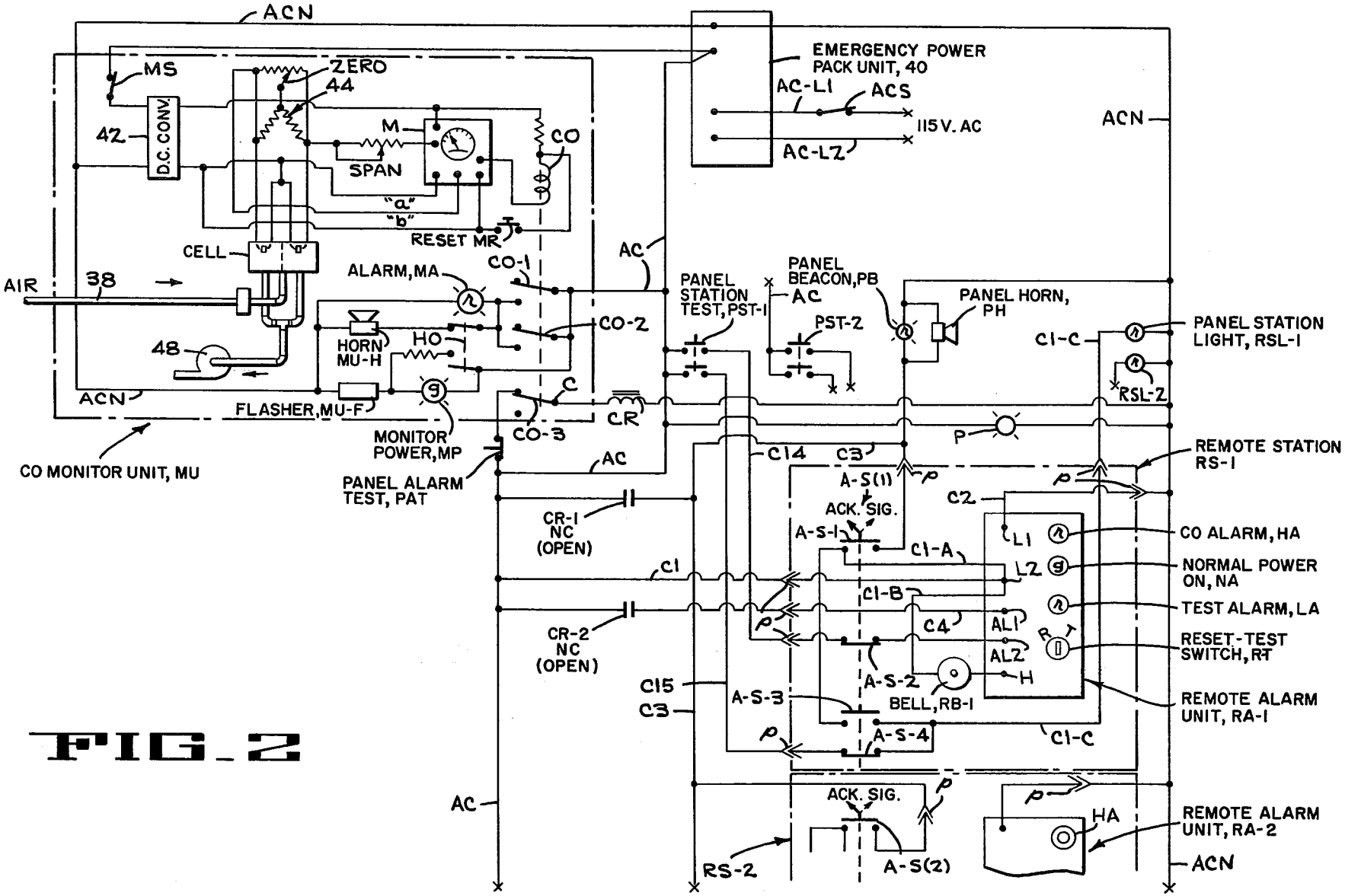
FIG. 2 is a schematic diagram showing the basic elements of the CO monitoring unit in simplified form, panel wiring and the connections of the remote station units to the panel. Only one of a number of remote units is shown complete.

FIG. 2 shows the basic wiring diagram of the system including additional details of the CO monitoring unit a remote unit acknowledge-signal switch, and the panel wiring. Only the remote station RS-1 is shown complete in FIG. 2 but an indication is given as to how other remote stations, such as RS-2, can be wired into the system. The CO monitoring unit MU (above deck) is enclosed in broken lines, as is the alarm unit at the remote station RS-1. These units include the remote alarm unit RA-1 and the acknowledge-signal switch A-S (1). Except for the power supply, the rest of the wiring can be considered part of the panel assembly connected between the CO monitoring unit and the remote alarm units in accordance with the present invention. Also, shown in detail in FIG. 2, is the internal wiring of the acknowledge-signal A-S (1). This switch is a four contact, two position switch which is normally in the "acknowledge" position, ACK and is so illustrated in FIG. 2. The switch can be set by the remote operator to the "signal" position SIG, which opens the contacts that were closed and closes the contacts that were open.

Details of the CO Monitor Unit

FIG. 2 only illustrates enough of the CO monitor unit MU to facilitate an understanding of the present invention, it being understood that such a unit is available to the trade as mentioned, and hence only the parts thereof necessary for complete understanding of the circuit system are shown in the figure.

The AC supply lines AC,ACN under control of the switch MS are directed to a DC converter 42 which delivers direct current for powering a bridge circuit 44, the meter M and a CO alarm relay CO. The bridge circuit 44 is a Wheatstone bridge, two legs of which are made up of resistances with the other two each connected to one element of a two element cell. One of the cell elements contains a CO detector compound and the other acts as a compensator. The cell receives air from the sample line 38 previously mentioned, and its compensator and detector compartments are exhausted by an air pump 48. Also included are temperature control and cell heater elements, not illustrated.

The bridge includes a "zero" check potentiometer for the resistance legs, which is set for zero output of the bridge after a warm up period when fresh air is admitted to the unit. Also included is a "span" adjustment, which is a calibration adjustment that is normally set when a known concentration of CO is admitted to the unit by the air line 38. The wires leading from the bridge provide electric signals which present the proportion of CO in the sample of air. It is to be understood that the details and mode of operation of the elements just described are not critical to the invention but merely represent the nature of a commercially available instrument which is preferably employed.

The bridge controls the reading of the meter M and also controls operation of the coil CO of an alarm relay. CO-2 and CO-3 The coil CO controls single throw contacts and the condition of these contacts shown in FIG. 2 is that which occurs when the coil CO is de-energized. The alarm relay coil CO operates a single throw contact CO-1 which can turn on the monitor alarm light MA and a single throw contact CO-2 which can energize the monitor horn MU-H. The relay further includes a normally closed single throw CO alarm contact CO-3 which contact is closed under normal conditions, that is, when the percentage of CO in the air sample is below a predetermined acceptable maximum. Thus, under normal conditions, the alarm relay coil CO is de-energized, which opens the contact CO-1 and darkens the monitor unit alarm light MA. Also, the relay contact CO-2 is open, which de-energizes the monitor horn MU-H, and as mentioned, the CO alarm contact CO-3 is closed. It will be noted in the drawings that each of the contacts CO-1, CO-2 has a contact arm and two contact points. One contact point is connected in a circuit and the other contact point is blind or not connected to a circuit. Hence each of the three contacts mentioned is functionally a single throw contact.

A single throw, double contact "horn off" switch HO is provided in the monitor unit circuit which has one contact that is normally closed to complete an alarm circuit from the power line ACN through the horn and through the normally open contacts of CO-2 when the latter are closed by the alarm relay coil CO. The power supply line ACN is also connected to a monitor flasher unit MU-F in series with the monitor power lite MP to the power line AC. The power light MP is normally on steady, but if the switch HO is shifted from the position illustrated, its lower contact closes and places a resistance in parallel with the light MP causing the latter to flash on and off.

When the CO in the air sample exceeds a predetermined maximum permissible percentage, the Wheatstone bridge circuit energizes the alarm relay coil CO, closes contact CO-1 to light the red alarm light MA, and closes the contact CO-2 to sound the horn MU-H. The green power light MP will remain lit. In addition, the relay coil CO opens the primary alarm signal contact CO-3 which is connected to the panel wiring at terminal C, the significance of which will be explained presently. The most critical portion of the CO monitor unit MU, as far as the present invention is concerned, is the effect of opening the CO alarm contact CO-3 upon the detection of an excess of carbon monoxide, for providing a primary CO alarm signal for the rest of the system.

Panel Assembly Wiring

Continuing with the description of FIG. 2, it will first be mentioned that the individual plug contacts of the plug P-1 between the remote alarm unit RA-1 (enclosed in broken lines) and the panel equipment are each indicated by nested arrowheads p. The panel assembly includes the aforementioned "station test" switches PST-1, PST-2, etc. Referring to switch PST-1, this switch includes two normally open contacts operated by a push button and connected to the power line AC. The upper contacts are connected by a line C14 to contact A-S-2 of the acknowledge-signal switch A-S (1) which in turn connects to terminal AL2 of the remote alarm unit RA-1. The interim wiring of a remote alarm unit, such as RA-1, will be described relative to FIG. 3 during a step by step description of system operation shown in FIGS. 4–11. Returning to FIG. 2, the lower contacts of the "station test" switch PST-1 connect through line C15, contacts A-S-4 of the acknowledge-signal switch, line C1-C the corresponding red panel station indicator light RSL-1 and the other power line ACN.

The panel wiring includes a power indicator light P connected between the power lines AC and ACN. As mentioned, the panel also includes a red panel beacon light PB and the panel horn PH connected in parallel therewith, the operation of which is controlled by the control relay CR, also referred to in the description of FIG. 1. The coil of relay CR is connected between the terminal C of the CO monitor unit and the power line ACN. Under normal conditions with the monitor unit relay coil CO de-energized and its normally closed alarm contact CO-3 closed, the coil CR of the control panel relay is energized from the power line AC through the normally closed contacts of the panel "alarm test" switch PAT and the power line ACN.

When the panel relay coil CR is energized under normal conditions, as described above, one of its contacts CR-1 is open. The contacts CR-1 are connected between the power line AC and the panel line C3, which connects to the panel beacon PB and the panel horn PH. These are connected to the other power line ACN. The other contacts CR-2 of the panel control relay CR are also open when the relay coil is energized. The contacts CR-2 are connected between the power line AC and the terminal AL1 on the remote alarm unit RA-1 by the line C4. The internal wiring of the remote alarm unit RA-1 is not shown in FIG. 2, but its terminal connections are.

The terminal L1 of the remote alarm unit is connected by line C2 to the power line ACN through a plug connection *p*. The terminal L2 of the remote alarm unit has three connections, one by means of line C1-A to the upper contacts A-S-1 and the lower contacts A-S-3 of the acknowledge-signal switch. Another line from L2 connects through a plug connection *p* and a line C1 to the power line AC. A third line from terminal L2 of the remote alarm unit connects to the bell RB-1, the bell connection being completed by connection to the terminal H of the remote alarm unit. The connections to the terminal AL1 have been mentioned before, as having connections to the remote alarm unit. The power lines AC and ACN and the line C3 continue on, as indicated in FIG. 2, for supplying power to other remote stations such as the remote stations RS-2, partially indicated in FIG. 2.

Remote Alarm Unit Wiring

Figure 3:
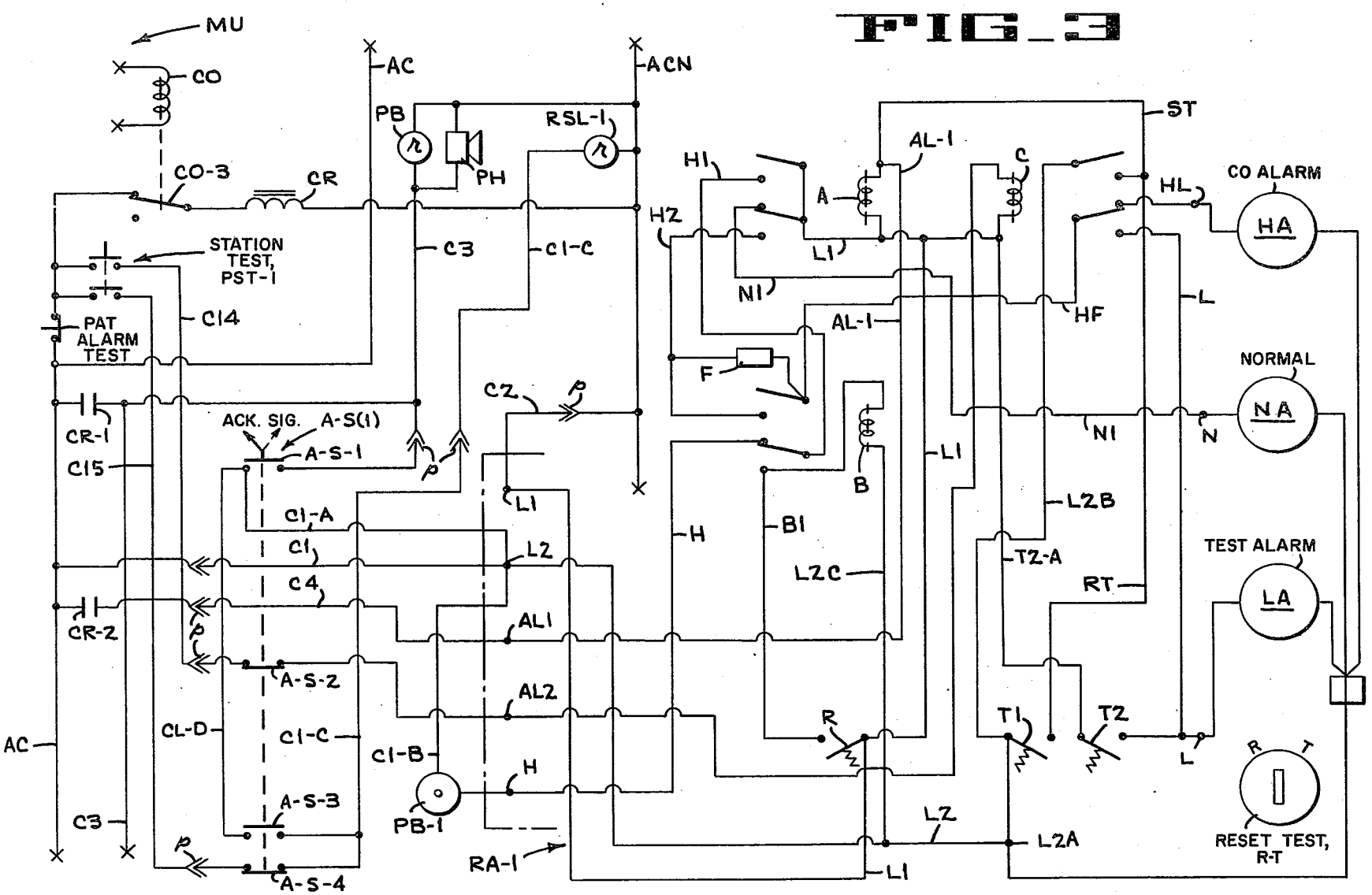
FIG. 3 is a schematic electrical diagram showing the internal wiring of one of the remote station alarm units with the lights and terminals thereof, and the CO alarm signal switch of the CO monitor unit.

FIG. 3 is a diagram showing the internal wiring of one of the remote alarm units. This figure shows the terminals of that unit previously mentioned in connection with FIG. 2 and also shows the wiring to those terminals and to the acknowledge-signal switch A-S (1) and the panel wiring previously described in connection with FIG. 2. FIG. 3 also shows a portion of the CO alarm relay and the CO alarm signal contact CO-3.

As previously mentioned, the remote alarm unit RA-1 includes a red CO alarm light HA which is normally off, a green normal power light NA which is normally on and a red test alarm light LA which is normally off. The unit also includes the reset-test switch R-T, having reset and test positions but in normal operation the switch is set in between these positions so that the reset contacts R are open and the two test contacts T1, T2 are also open.

The remote alarm unit RA-1 includes an alarm relay A which includes single throw upper contacts and double throw lower contacts. In FIG. 3 the relay A is shown de-energized, as are always B and C also incorporated in the unit. The relay B has single throw upper contacts for bypassing and flasher F and double throw lower contacts. The relay C also has single throw upper contacts and double throw lower contacts.

Power for the remote unit RA-1 is derived from its terminal L1 which connects to the power line ACN via the line C2 as previously described, and from the terminal L2 which connects to the power line AC through the line C1, as also previously described. The operation of the entire system including the internal relays A, B, C and other internal elements of the remote alarm units RA-1 will be traced in detail in the following series of descriptions of the operation of the system.

Operation

The operation of the system will be described in connection with the sequence of schematic diagrams of FIGS. 4–11. These diagrams show the basic effects of various modes of operation. After a general description of each of the diagrams 4–11 will appear a detailed circuit description referring to FIG. 3 which shows the internal wiring of a remote alarm unit.

The operational description will be divided into two sections:

I. Above deck testing, when the remote units are brought above deck and are plugged into and are adjacent the panel assembly.

II. Below deck operation, when the remote alarm units are mounted at their various stations and are plugged into the panel assembly, as indicated in FIG. 1.

In the descriptions that follow, it will be assumed that power is being supplied to the power lines AC and ACN, previously identified, and that the acknowledge-test switches and associated remote alarm units are plugged into the panel assembly wiring by the respective plugs P-1, P-2, etc. (FIG. 1). In these diagrams of FIGS. 4–11 the panel wiring is enclosed in broken lines. As to the CO monitor unit MU, alarm contacts CO-3 are indicated. The internal connections of acknowledge-signal switch A-S (1) and the remote alarm unit RA-1 are now shown. Also, these diagrams only show the connections to the first remote station RS-1.

I. Remote Unit at Panel

Figure 4:
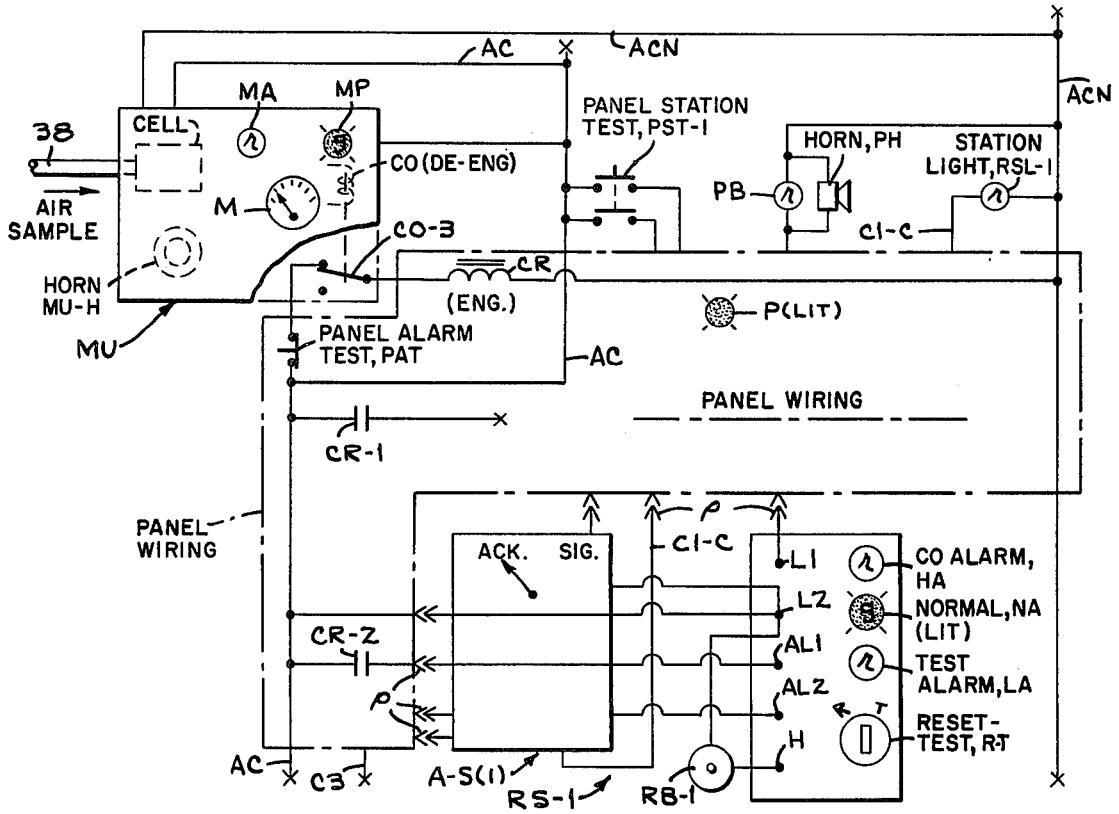
FIGS. 4–11 are simplified schematic operational diagrams showing the CO monitoring unit, connections thereof to the panel wiring, the panel test and alarm units and the remote claim unit and its acknowledge-signal switch to the panel.

A. Normal (FIG. 4)

It is assumed that the carbon monoxide in the air sample is at a safe value. In normal operation, the red monitor unit alarm light MA is darkened and the power indicator light MP is on and steady. The meter M shows a value of CO concentration below the danger limit and the alarm relay coil CO is de-energized, closing the normally closed alarm contacts CO-3. The panel light P, indicating power to the panel is lit, the "station test" switch PST-1 at the panel is open and the panel alarm test switch PAT is closed. The panel beacon light PB and the panel horn PH are de-energized. Both of the contacts CR-1 and CR-2 of the panel relay CR are open.

At the remote station, the acknowledge-signal A-S (1) switch at the remote station RS-1 is set to the "acknowledge" position ACK. The reset-test switch is set at its intermediate position, the CO alarm light HA of the remote unit RA-1 is dark, the normal power light NA of the remote unit is lit and the test alarm light LA of the remote unit is dark. Also, the bell RB-1 of the remote unit is silenced. This indicates that no false CO alarm is provided by the monitor unit MU and when the remote unit is plugged in below deck these conditions indicate that the amount of carbon monoxide in the respiratory air is at a safe level.

IA — Detailed Description (FIG. 3)

1. Alarm signal contact CO-3 closed and panel relay coil CR energized from power line AC, closed "alarm test" switch PAT, alarm contact CO-3, the relay coil CR and power line ACN.

a. Relay contacts CR-1 held open, de-energizing the line C3 leading from the contacts CR-1 to the panel beacon PB and the panel horn PH so that these alarm units are not activated.

b. Relay contacts CR-2 held open, de-energizing line C4, remote unit terminal AL1, and the coil of relay A, so that the contacts of that relay are in their upward position as shown.

1. The lower, double throw contacts of relay A disconnect the power line ACN and L1 from the line H2, de-energizing the flasher F, the line HF, the terminal HL and the CO alarm light HA, the other side of which is connected to the power line AC through L2A, and L2.
2. The double throw contacts of relay A light normal power light NA. The connections are from power line AC, panel wiring line C1, remote unit terminal L2, remote unit line L2A, the light NA, the remote unit junction N and its line, the fixed contact of the lower double throw contacts of relay A (de-energized), the line L1 and the power line ACN.
3. The upper, single throw contacts of relay A disconnect the power line L1 from line H1, the upper double throw contact of relay B, (de-energized), line H and the remote alarm bell RB-1.

Thus the only affect at the remote unit in normal operation is that the green power light NA is on steady. Lights HA and LA are off and the alarm bell is silenced. This situation is the same whether the remote unit is plugged in on deck for testing or is plugged in below deck in operation.

I. Remote Unit at Panel

Figure 5:
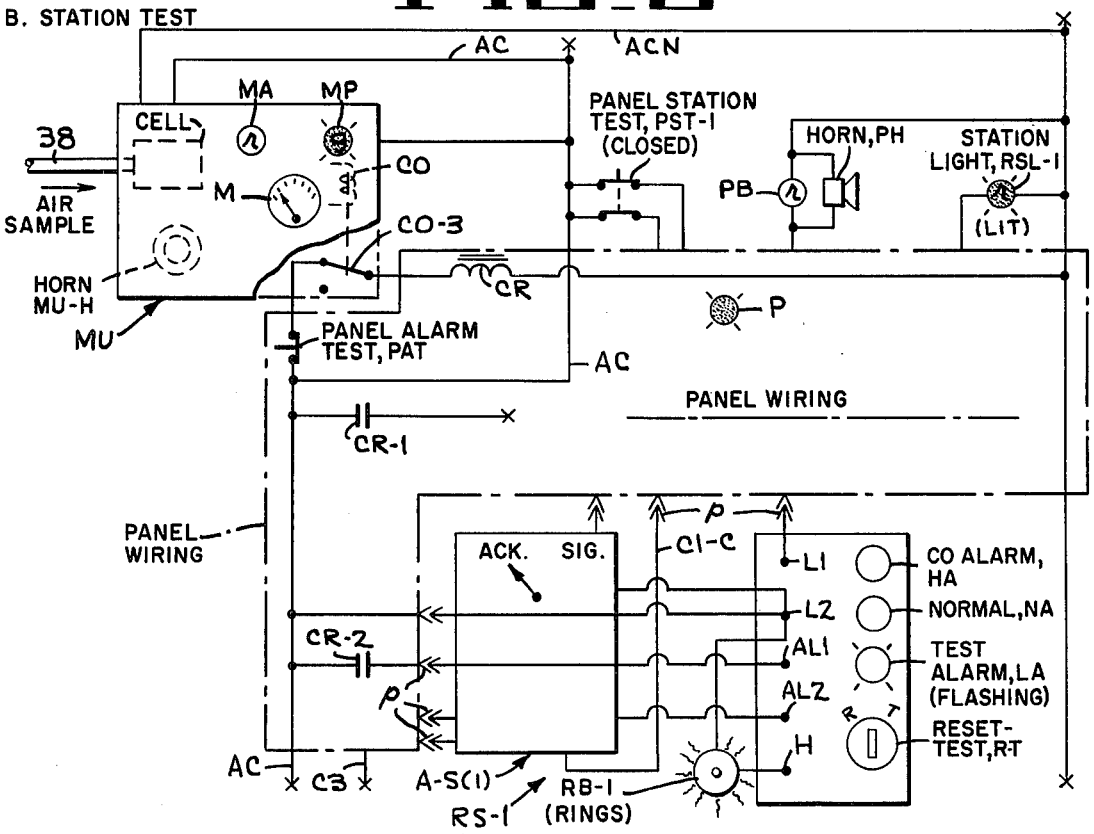

B. Station Test (FIG. 5)

The CO alarm contacts CO-3 and the panel "alarm test" switch PAT are closed as before. At the remote unit, the "acknowledge-signal" switch is set at acknowledge (ACK) and the reset-test switch R-T on the remote alarm unit RA-1 is at neutral as before.

The double contact panel "station test" switch PST-1 is closed in order to test the corresponding remote alarm unit. Although the CO alarm light HA remains off this test lights the test alarm LA through the flasher. Also, the normal power light NA is turned off and the station indicator light RSL-1 at the panel is lit, indicating that the units for remote station RS-1 are being tested. Of course, this test is performed individually for all of the remote units which have been brought up next to the panel by pressing their corresponding "station test" buttons, PST-1, PST-2, etc.

The alarm bell RB-1 for the remote alarm unit RA-1 will ring. The panel beacon light PB and its horn PH are de-energized.

I-B — Detailed Description (FIG. 5)

1. The CO alarm contact CO3 is still closed, energizing the relay coil CR, and opening its contacts CR-1 and CR-2. The opening of contacts CR-1 disconnects line C from the power line AC and, hence, de-energizes the panel beacon PB and the panel horn PH. The opening of relay contacts CR-2 has no effect on the circuit during the station test.

2. Panel "station test" switch PST-1 contacts closed.

a. The panel station indicator light RSL-1 is energized from the power line AC, the lower contacts of the station test switch PST-1, line C15, contacts A-S-4 of the acknowledge-signal switch, the light RSL-1 and the power line ACN.

b. Relay C in the remote alarm unit is energized from power line AC, the upper contacts of the panel "station test" switch PST-1, line C14 contacts A-S-2 of the acknowledge-signal switch, remote alarm unit terminal and line AL-2, the coil of relay C, line L1 and power line ACN.

1. The remote unit relay A is energized from power line AC, L2, L2B the upper, single throw contacts of relay C (energized) line ST, the coil of the relay A, L1 and the power line ACN.

2. The lower, test alarm light LA at the remote unit is lit from the power line AC, line C1, L2, L2A, the light LA, line L, the lower contact of the lower, double throw switch of the relay C, line HF, the flasher F, line H2, the lower contact of the lower, double throw contacts of the relay A, line L1 and the power line ACN.

3. The bell RB-1 rings from the power line AC, panel line C1, terminal L2, line C1B, H, the upper contact of the double throw contacts of relay B (de-energized), line H1 the single throw contact of relay A (energized), L1, and the power line ACN.

4. The remote unit CO alarm light HA is turned off when the lower, double contacts throw of relay C (energized) open the connection of HL for the light HA from the line HF.

5. The remote unit green power light NA, which is normally on, is turned off when the upper fixed contact of the lower, double throw contact of relay A (energized) disconnects the line N leading from the light NA from the line L1 which connects to the power line ACN.

6. The remote unit normally on green power light NA is turned off when the lower double throw contacts of relay A (energized), open the connection of line N leading from the light NA to the power line L1.

I — Remote Unit at Panel

Figure 6:
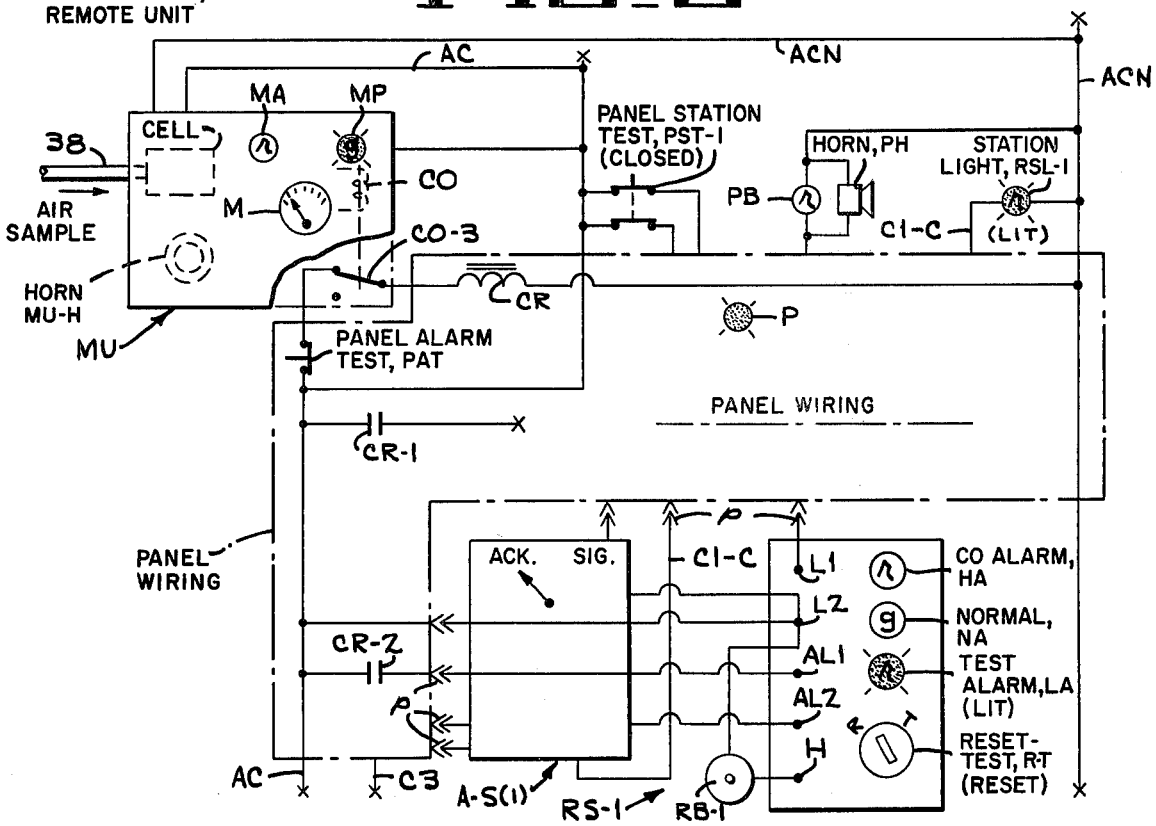

C — Station Test — Preset at Remote Unit (FIG. 6)

FIG. 6 illustrates diagrammatically the effect of the reset operation at a remote unit while the same is above deck at the panel. The panel conditions are the same as those in FIG. 5, just discussed, in that the CO-3 alarm contacts of the monitor unit MU are still closed, the panel alarm test switch PAT is still closed, the panel relay coil CR is energized and the panel "station test" button PST-1 is still held closed by the panel operator. The latter causes the station indicator light for RSL-1 for the remote unit RA-1 to remain lit, as before.

1. The reset-test switch R-T at the remote unit RA-1 is turned to "reset". The acknowledge-signal switch A-S(1) is still at "acknowledge". The CO alarm light HA at the remote unit remains dark, and does the normal power light NA in accordance with the detailed circuit description of FIG. 5. The remote unit test alarm light LA, which was formerly flashing, is now on steady and the remote unit alarm bell RB-1, which was formerly ringing, is now silenced.

I-C — Detailed Description

Referring again to FIG. 3, the circuit which results in the operations shown in FIG. 6 are as follows:

1. Reset — test switch R-T on the remote unit RA-1 is turned to the "reset" position R.

a. The remote unit relays A and C remain energized as described in connection with FIG. 5, the reset-test switch having no effect on the circuits to their coils.

b. The remote unit relay B is now energized from the power line AC, panel line C1, L2, remote unit line L2C, the coil of relay B, remote unit line B1, the reset contacts R, L1, and power line ACN.

1. When relay B is energized, the upper, single throw contacts of relay B close and bypass the flasher F. This causes the remote unit test alarm light LA to be lit as before but it is now on steady.

2. When the relay B is energized by turning the reset-test switch to reset position R, the upper contact of the lower, double throw contacts of the relay B disconnects the line H from the bell RB-1 from the remote unit line H1 to which it was formerly connected. This silences the bell RB-1 of the remote unit RA-1.

I — Remote Unit At Panel

Figure 7:
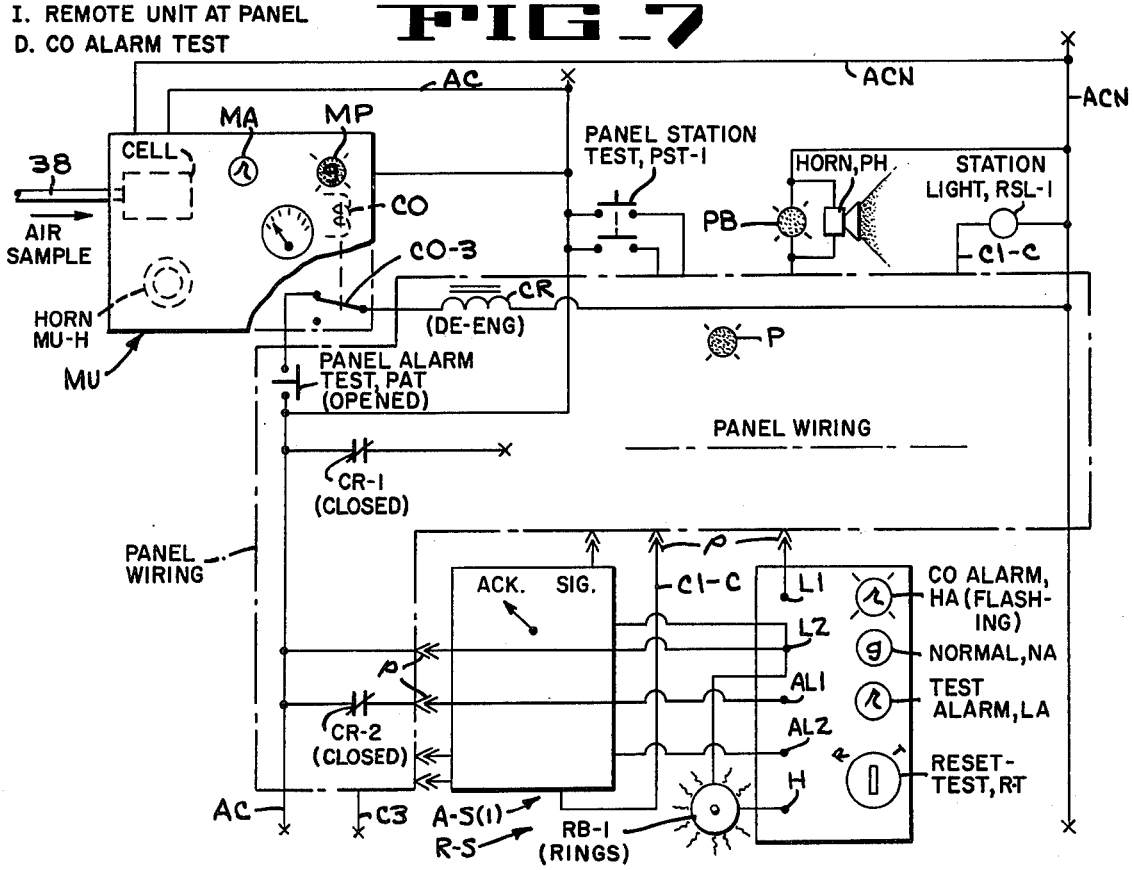

D — CO alarm test (FIG. 7)

When the remote units are on deck at the test panel, they are all tested simultaneously, in order to insure that when they are placed at their remote stations and a carbon monoxide alarm signal is actually provided by the opening of the monitor unit contact CO-3, the resultant CO alarm signal will operate to provide the proper alarm, namely the CO alarm lights HA should light up and be flashing and the remote unit alarm bells, such as the bell RB-1 should ring.

Before performing this test at the panel, the monitor unit contacts CO-3 are closed because care is taken to see that the air sample entering the unit if fresh air and does not contain an excess of CO. The panel "station test" switches PST are left open for all remote units. Each remote unit has its acknowledge-signal switch, A-S(1) for example, set to "acknowledge" and each remote unit has its reset-test switch RT in neutral position.

To perform the CO alarm test, the panel alarm test switch PAT is opened. This de-energizes the panel relay CR causing the relay contacts CR-1 and CR-2 to close. At the panel, the red panel beacon PB lights up and the panel horn PH sounds. None of the red station indicator lights such as RSL-1 are turned on because their respective panel test switches, such as PST-1, are left open.

At each remote unit, the red CO alarm light HA is on and flashing. The green normal power light NL is off, the red test alarm light LA is off and the remote CO alarm bell, such as the bell RB-1 rings. Thus, the panel operator can check to see that all of the remote units will properly respond to an actual CO alarm when the panel alarm test switch PAT is in its normally closed position, but when the monitoring unit MU opens the alarm contact CO-3 to provide an actual CO alarm signal.

I-D — Detailed Description (FIG. 7)

1. Panel alarm test switch PAT opened, panel relay CR de-energized, relay contacts CR-1 and CR-2 closed.
   a. The red panel beacon PB and the panel horn PH are energized from power line AC, relay contacts CR-1, panel line C3, the panel light and the horn and power line ACN.
   b. The remote unit relay A is energized from power line AC, closed relay contacts CR-2, panel line C4, remote unit terminal AL1 and its internal line, the coil of relay A, L1 and power line ACN. This moves the movable contacts relay A from their upper position shown in FIG. 3 to their lower position.
      1. The remote unit normally on green power light NA is turned off due to disconnection of line N1 and line N from the circuit L1 by the opening of the upper fixed contact of the lower, double throw switch of remote unit relay A.
      2. The CO alarm light HA is turned on and flashing through power line AC, panel line C1, L2, L2A, the light HA, terminal HL, the upper fixed contact of the lower, double throw switch of the relay C (de-energized) remote unit line HF, the flasher F, remote unit line H2, the lower fixed contact of the lower double throw switch of the relay A (energized), line L1 and power line ACN.
      3. The alarm bells for each remote unit, such as the bell RB-1, rings through power from the power line AC, panel line C1, remote unit terminal L2, line C1-B, the bell, remote unit terminal and internal line H, the upper fixed contact of the lower, double throw switch of the relay B (de-energized), remote unit line H1, the single throw contact of the relay A (energized), line L1 and the power line ACN.
      4. The test alarm light LA at each remote unit is turned off because its remote unit relay C has not been energized and the lower fixed contact of the double throw contacts of relay C disconnect the line L for the light LA from the line HF and hence from the rest of the circuit.

I — Remote Unit at Panel

Figure 8:
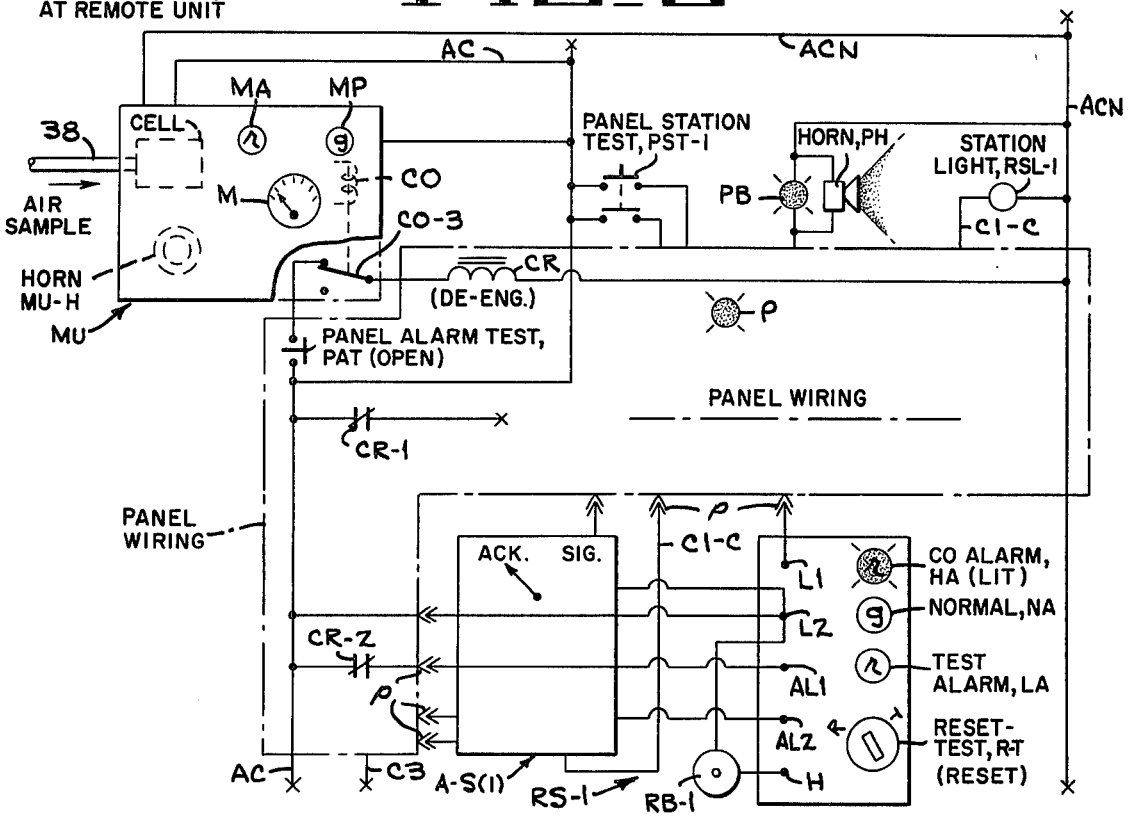

E — CO Alarm Test, Reset at Remote Unit (FIG. 8)

After the CO alarm test, just described in connection with FIG. 7 has been performed, and while the remote units are still at the panel, the reset test is conducted. The conditions at the panel are as before, namely the CO monitoring unit MU alarm contact CO-3 is closed but the panel alarm test switch PAT is still held open, keeping the panel alarm relay CR de-energized and its contacts CR-1 and CR-2 closed. The panel "station test" switches PST-1, etc. for the various remote units are not depressed and the panel beacon PB and the panel horn PH are still energized by the closed relay contacts CR-1, as before.

At the remote unit, the acknowledge-signal switch is still on acknowledge but the reset-test switch R-T of the remote unit is set to the "reset" position R. The result is that the CO alarm light HA at the remote unit remains lit but is now on steady but the bell for each remote unit, such as the bell RB-1, is off or silenced.

I-E — Detailed Description (FIG. 8)

1. "Station test" switches open.
2. Panel alarm switch PAT still held open.
   a. Panel relay CR de-energized, closing contacts CR-1 and energizing panel beacon PB and horn PH.
   b. Remote unit relay A energized through contacts CR-2, as in I-D, I-B The remote unit CO alarm light HA is now on steady from power line AC, line C1, L2, L2A, the light HA, HL, upper fixed contact of double throw switch of remote unit relay C (de-energized), line HF, single throw contacts of relay B (energized) thereby bypassing the flasher F, remote unit line H2, the lower contact of the double throw switch of relay A (energized), line L1 and power line ACN. Thus the remote unit alarm light HA is on steady.
3. As mentioned, the remote unit relay B was energized when the reset-test switch R-T was set to the reset position R. The power is from power line AC, line C1, L2, the coil of relay B, internal line B1, the reset contact R, internal line and terminal L1, panel line C2 and power line ACN.
   a. The remote unit bell RB-1 is silenced when the upper, fixed contact of the double throw switch of relay B (energized) is disconnected from the line H connected to the bell.
   b. The remote unit flasher F is bypassed by the single throw contacts of the relay B so that the CO alarm light HA remains on steady as in 2b, above.

II — Remote Units Below

A — Normal (same as FIG. 4)

After the above-deck testing previously described, the remote units are set up at the various remote stations and power is supplied to the system. The air compressor system is in operation and the CO monitor unit MU samples the air supply to the worker's respirators. Assuming that the air sample to the monitor unit does not contain an excess of CO, the CO alarm contact CO-3 will be closed, the panel relay CR will be energized and the remote unit will be in its normal condition, as previously described. Under these conditions, at each remote unit the CO alarm light HA is turned off, the normal power alarm light NA is lit, and the test alarm light LA is turned off. The remote unit alarm bell is silenced.

II — Remote Unit Below

Figure 9:
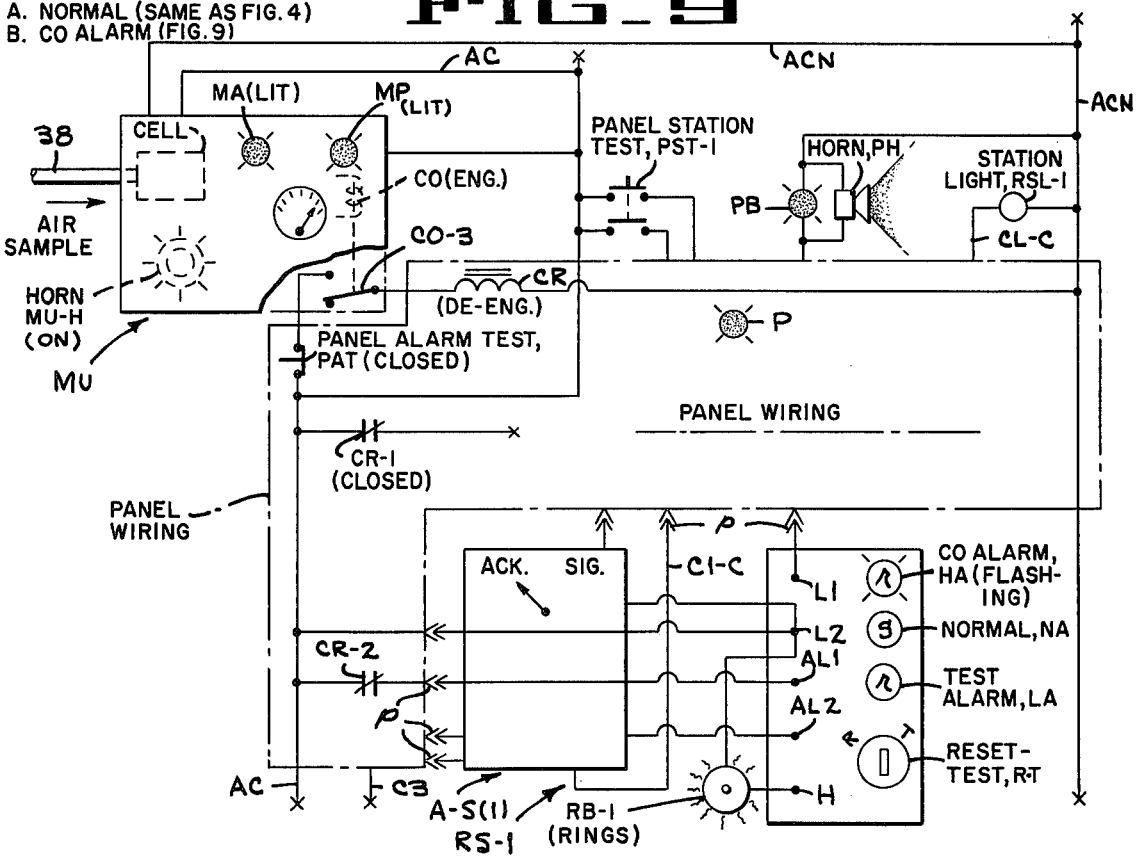

B — CO Alarm (FIG. 9)

In case the air sample to the CO monitor unit MU contains an excess of carbon monoxide, the monitor unit sensing cell responds and unbalances the Wheatstone bridge. Motor M indicates the excess and the red metering alarm light MA lights up. Also, the monitor unit horn is sounded, so that the monitoring unit itself now indicates that it is providing an alarm signal to the system. Simultaneously, the bridge circuit energizes the monitor unit relay CO which opens the alarm contacts CO-3 and this represents a primary carbon monoxide alarm signal.

When the primary alarm signal is provided, the panel relay CR is de-energized, closing the relay contact CR-1 and CR-2. As a result, the red panel beacon light PB is lit and the panel horn PH is activated. At the remote unit, the red CO alarm light HA is on and flashing and the bell, such as bell RB1 at the first station, rings. Of course these actions take place at all of the remote units. The normal green power light NA is turned off and the red test alarm light LA is also off. Thus, a signal is provided to the remote station personnel that the quantity of carbon monoxide in their respiratory air supplies is dangerous, whereupon they should immediately leave their work stations. The panel operator has also received an indication of the CO alarm not only from the light and horn in the monitor unit; but, also, from the panel beacon PB and the panel horn PH. These alert the panel operator that people should be immediately dispatched to various remote stations to insure that the workers therein are evacuated.

II-B — Detailed Description

The circuit for the CO alarm conditions of FIG. 9 is like that described in connection with FIG. 7, (CO alarm test at panel), except that in FIG. 7 the alarm signal is provided by opening the panel alarm test switch PAT, whereas in the actual CO alarm condition of FIG. 9, an actual CO alarm signal is provided by the opening of the monitoring unit CO alarm switch contact CO-3. Opening of the CO alarm contact CO-3 has the same effect on the circuit as does opening the panel alarm test switch PAT.

II — Remote Units Below

Figure 10:
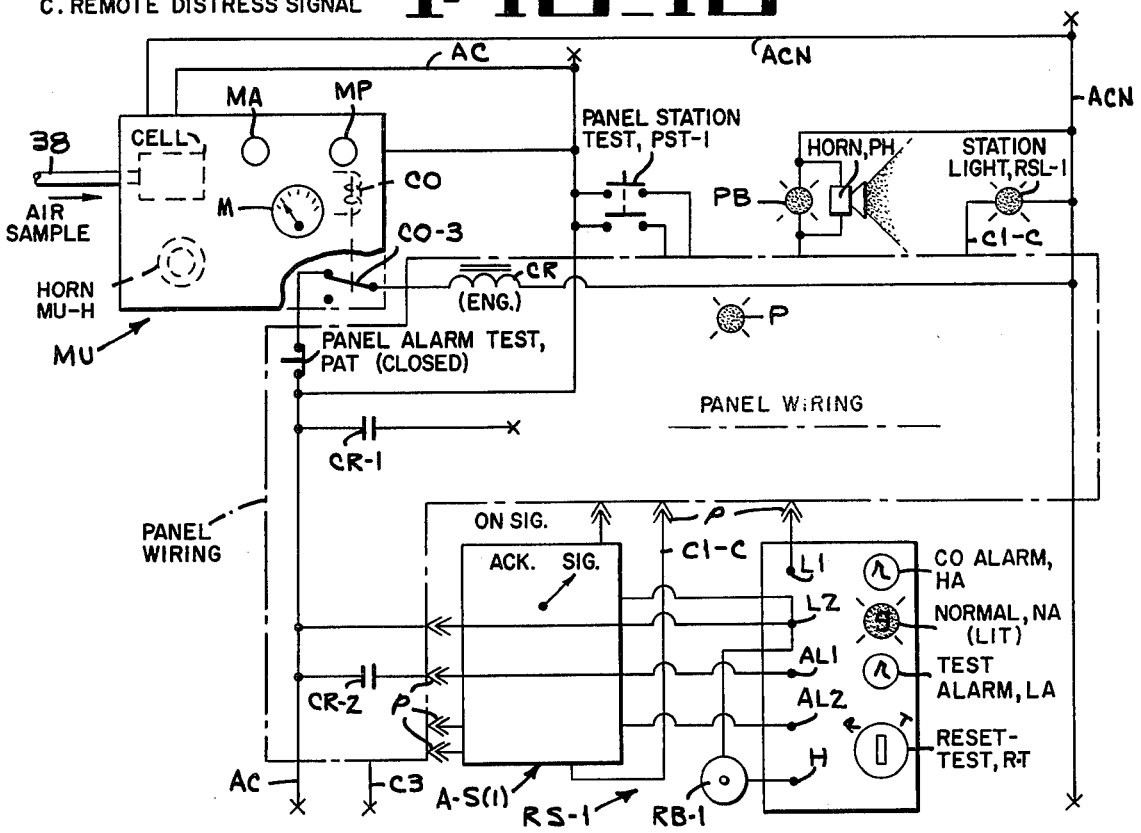

C — Remote Distress Signal (FIG. 10)

The panel wiring and the remote unit acknowledge signal switch of the present invention make it possible for a workman at any of the remote stations to signal the panel operator above deck that the remote workman is in distress, that something has gone wrong with the remote unit wiring, such as a situation wherein the normal circuit described in connection with FIG. 4 is not in operation, or that help is required for any reason. Upon receipt of this signal, one or more personnel from above deck are immediately dispatched to the remote station indicated by the panel station light, such as RSL-1, on the panel and the distress signal cannot be cancelled except by resetting the acknowledge-signal switch at the remote station that initiated the distress signal.

Referring to FIG. 10, the monitor unit MU does not indicate an excess of CO in the air supply so that the CO alarm switch contacts CO-3 are closed, energizing the panel relay CR as in normal operation. Also, the panel alarm test switch PAT is closed and as a result the panel contacts CR-1 and CR-2 are open, as in normal conditions. However, at a remote station, such as the remote station RS-1, the remote worker has set the acknowledge-signal switch A-S(1) to the "signal" position. This does not affect that station's remote unit RA-1 in that, (unless the wiring is defective) the green normal power light NA remains lit and the CO alarm light HA and test alarm light LA are off. Also, the remote alarm bell RB-1 is not ringing. However, at the panel, the red panel beacon PB is lit and the panel horn PH is on. Also the remote station light corresponding to the remote station sending the distress signal (in this case light RSL-1) is lit. This informs a panel operator of a distress signal at the station indicated by the station light so that personnel can be immediately dispatched to the remote station and investigate the reason for the distress signal from that station.

II-C — Detailed Description (FIG. 10)

1. At the remote station, such as RS-1, the operator has turned the acknowledge-signal switch A-S(1) to the "signal" position. This switches all four contacts of that switch from their positions shown in FIG. 3 to a position wherein the previously open contacts A-S-1 and A-S-3 are closed and previously closed contacts A-S-2 and A-S-4 are opened.

a. Shifting of the contacts of the acknowledge-signal switch lights the panel beacon light PB and energizes the panel horn PH through the power line AC the panel line C1, remote terminal unit L2, panel line C1A, acknowledge signal switch contacts A-S-1 the panel light PB and the panel horn PH, and the power line ACN.

b. The station indicator light (in this case panel light RSL-1) is lit through the power line AC, panel line C1, remote unit terminal L2, panel line C1-A, panel line C1-D connecting the switch contacts A-S-1 to the switch contacts A-S-3, the switch contacts A-S-3, panel line C1-C, the panel indicator light RSL-1 and the power line ACN.

2. The red CO alarm light HA and the alarm bell at the remote unit may be off or may be on. They will be off if the monitoring unit contact CO-3 is closed, as shown in FIG. 10 or it could be lit in case of an actual CO alarm, as described in connection with FIG. 9. Regardless of the remote condition unit light, the distress signal just described will be received by the panel operator.

3. The green normal power light NAat the remote unit may be either on or off, depending on the same conditions that determine the conditions of the CO alarm light HA and the remote unit bell, described above.

II — Remote Unit Below

Figure 11:
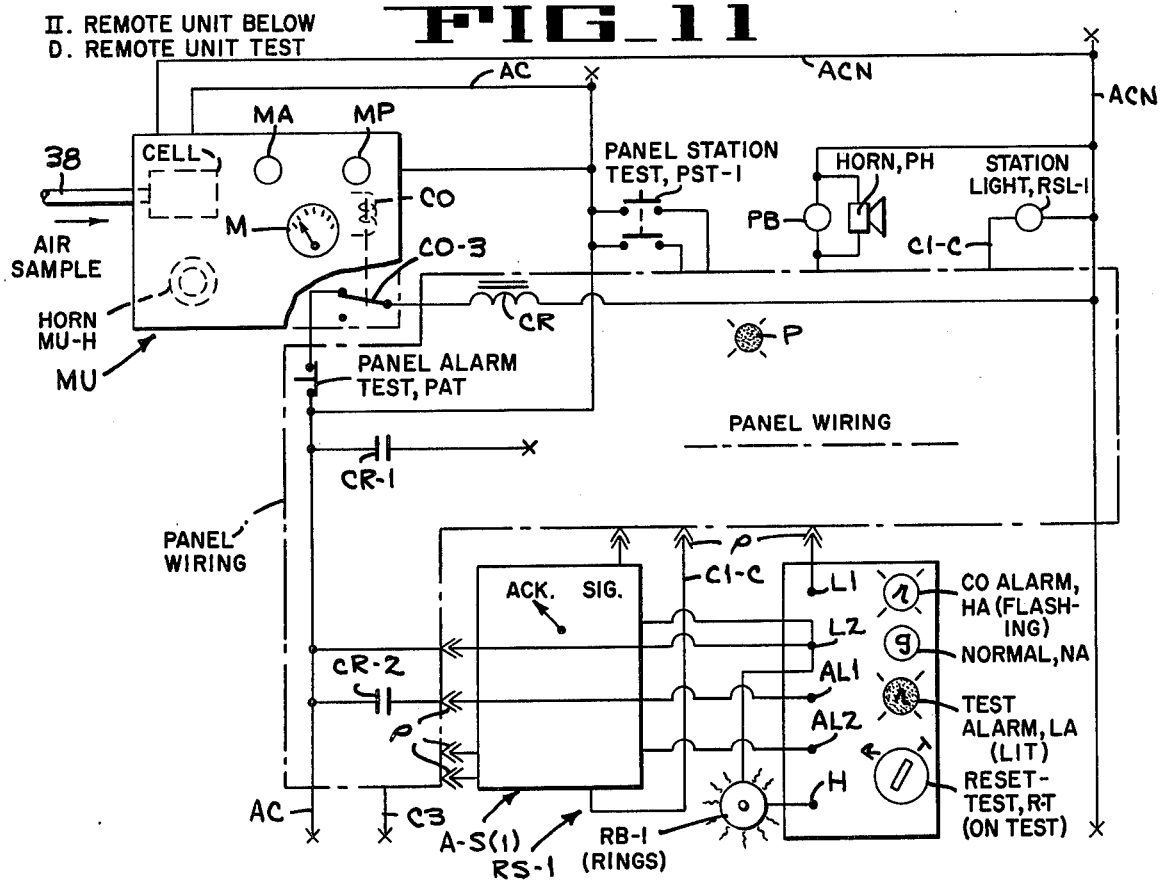

D. Remote Unit Test (FIG. 11)

Any remote station personnel or workman can test the operability of his remote alarm unit without signaling the panel operator to proceed to his station. The conditions resulting from such a test are shown in the diagram of FIG. 11. It is assumed that the air sample is satisfactory so that the monitoring unit provides no CO alarm signal and maintains the CO alarm contact CO-3 closed, thereby de-energizing the relay CR and opening contacts CR-1 and CR-2.

It is also assumed that the panel alarm test PAT is closed and that the panel station test switches PST-1, etc. are not depressed. As a result, the panel beacon PB and the panel horn PH are de-activated and the various station indicator lights, such as light RSL-1 for remote station RS-1 are off.

In order to perform the test, personnel at any remote station turns the reset-test switch R-T to the "test" position T. The acknowledge-signal switch is left in the "acknowledge" position. As a result of this operation of the reset-test switch, the red CO alarm light HA will be on flashing, the green normal alarm light NA will be off, the red test alarm light LA will be on steady and the remote alarm bell RB-1 will ring.

II-D — Detailed Description (FIG. 3)

The circuit connections which result in the condition just described in FIG. 11 can be traced from FIG. 3 as follows:

1. Setting the reset-test switch R-T to the test position T closes the remote unit test contact T1. This energizes the relay A through power line AC, panel line C1, L2, the test switch T1, remote unit lines RT and ST, the coil of relay A, L1, and the power line ACN.

a. When relay A is energized, the remote bell RB-1 is energized through the power line AC, the panel line C1 to the remote unit terminal L2, the line C1-B, the bell, remote line H, the upper fixed contact of the double throw switch of relay switch B (de-energized), remote line H1, the single throw contacts of relay A (energized) L1 and the power line ACN.

b. The CO alarm light HA at the remote unit is lit from the power line AC, the panel line C1, the remote unit terminal L2 and its line the remote unit line L2A, the CO alarm light HA, its terminal HL, the upper fixed contact of the double throw switch of relay C (de-energized), the remote unit line HF, the flasher F, the remote unit line H2, the lower fixed contact of the double throw switch of the relay A (energized), L1 and the power line ACN.

2. The remote unit test contact T2 is also closed, when the reset-test switch is set to the test position T.

a. The red test alarm light LA is lit from the power line AC, panel line C1, L2, L2A, the test alarm light LA, L, the closed contact T2, the remote unit line T2-A, L1, and the power line ACN.

b. The green normal power light NA at the remote unit is off; because, when relay A was energized as previously described, the line N connected to the light NA was disconnected from the power line ACN, L1 by the opening of the upper fixed contact of the double throw switch of the relay A.

Having completed a detailed description of the preferred embodiment of the invention, it can be seen that the inter-positioning of the panel wiring and acknowledge-signal switch between a carbon monoxide monitor unit and remote station alarm units, coupled with the use of panel station indicator lights and a panel horn and warning beacon renders the system reliable and fool proof. All of the remote systems can be tested for operation under various conditions including a simulated CO alarm above deck, before they are installed at their respective remote stations.

The remote units are installed at their respective remote stations, re-plugging them into their respective panel plugs, if necessary. Once below, if the remote units will indicate normal conditions, as in FIG. 4, this indicates that the system is in operation. The panel operator can periodically perform station tests (FIG. 5), followed by reset tests (FIG. 6) which further gives indication that the system is functioning. The remote workers can test their individual remote alarm units with their reset-test switch in the test position T. The CO monitor unit MU is periodically checked by supplying its air sample line with air containing a known and unsafe percentage of carbon monoxide. Distress signals from any remote station can be reset to the panel operator by setting the acknowledge-signal switch to its signal position. Thus a virtually infallible and easily tested carbon monoxide alarm system is provided for workers at remote stations such as the holds of ships, mines, etc.

Although the best mode contemplated for carrying out the present invention has been herein shown and described, it will be apparent that modification and variation may be made without departing from what is regarded to be the subject matter of the invention.

I claim:

1. A remote personnel station alarm system comprising an external station, a remote personnel station, means at said external station for supplying air to said remote station, a gas monitor unit at said external station having means for providing a primary alarm signal upon detection of dangerous gas in said air supply, a remote alarm unit normally at said remote station and having gas alarm warning means, means for electrically connecting said remote alarm unit to said gas monitor unit for providing a gas alarm warning at said remote alarm unit in response to a primary alarm signal from said monitor unit, and an electric power supply for said units; the improvement wherein said electrical connecting means comprises an external panel assembly electrically connected to said monitor unit and to said power supply, an electric signal wire cable connected to said remote alarm unit at one end and having plug means at the other end for connection to corresponding plug means for said panel assembly so that said remote unit can be disposed at said panel assembly for testing and at said remote station during operation, said panel assembly having a station test switch for said remote station and a normally dark station indicator light, said remote alarm unit also having a test alarm light and a light flasher, and means for causing operation of said station test switch at the panel assembly to light said station indicator light at said panel assembly and to light said test alarm light at the remote alarm unit through said flasher without operating the gas alarm warning means at said remote alarm unit.

2. The system of claim 1, wherein said remote alarm unit also has a reset switch, means for causing operation of said reset switch at the remote alarm unit while said station indicator switch at the panel assembly is still operated, to bypass said flasher so that said test alarm light at the remote alarm unit is on steady.

3. The system of claim 1, wherein said gas alarm warning means at the remote alarm unit comprises an audio warning device and a gas alarm light that are normally off and a power indicator light that is normally on, means for causing operation of said station test switch at the panel assembly to turn off said power indicator light and to energize said gas alarm light and said audio warning device.

4. A remote personnel station alarm system comprising an external station, a remote personnel station, means at said external station for supplying air to said remote station, a gas monitor unit at said external station having means for providing a primary alarm signal upon detection of dangerous gas in said gas supply, a remote alarm unit normally at said remote station and having gas alarm warning means, means for electrically connecting said remote alarm unit to said monitor unit for providing a gas alarm warning at said remote alarm unit in response to a primary alarm signal from said monitor unit, and an electric power supply for said units; the improvement wherein said electrical connecting means comprises an external panel assembly electrically connected to said monitor unit and to said power supply, an electric signal wire cable having plug means for connecting said remote alarm unit to said panel assembly so that said remote unit can be disposed at said panel assembly for testing and at said remote station during operation, said panel assembly having secondary gas alarm means operable when said monitor unit produces a primary alarm signal, a panel alarm test switch at said panel assembly, and means for causing operation of said panel alarm test switch to activate said secondary alarm means at said panel assembly and to energize said gas alarm warning means at said remote alarm unit independently of the condition of said primary alarm signal means of the gas monitor unit.

5. The system of claim 3, wherein said gas alarm warning means of said remote alarm unit comprises a gas alarm light, a light flasher, and an audio alarm device, said remote alarm unit having a reset switch, means for causing operation of said panel alarm test switch to light said gas alarm light through said flasher and to energize said audio alarm device, and means for causing operation of said reset switch on the remote alarm unit to bypass said flasher leaving said gas alarm light on steady, and silence the audio alarm device of said remote alarm unit while said panel alarm switch remains operated.

6. A remote personnel station alarm system comprising an external station, a remote personnel station, means at said external station for supplying air to said remote station, a monitor unit at said external station having means for providing a primary alarm signal upon detection of dangerous gas in said air supply and primary alarm means responsive to said primary alarm signal, a remote alarm unit at said remote station and having gas alarm warning means, means for electrically connecting said remote alarm unit to said monitor unit for providing a gas alarm warning at said remote alarm unit in response to a primary alarm signal from said monitor unit, and an electric power supply for said units; the improvement wherein said electrical connecting means comprises an external panel assembly electrically connected to said monitor and remote alarm units and to said power supply, said panel assembly having secondary alarm means normally operable only when said primary alarm signal means is operated, said panel means also having a remote station indicator light, two position signal switch means at said remote station and electrically connected to said panel assembly, said signal switch means having a normal acknowledge position wherein said panel assembly secondary alarm means is controlled by the primary alarm signal of said monitor unit and the station indicator light at said panel assembly is dark, said signal switch means having a signal position which energizes said secondary alarm means and lights the station indicator light at said panel assembly independently of the condition of said primary alarm signal for summoning a panel assembly operator to said remote station.

* * * * *

CERTIFICATE OF CORRECTION

Patent No. 4,067,004 Dated January 3, 1978

Inventor(s) WILLIAM GULBRANTSON

It is certified that error appears in the above-identified patent and that said Letters Patent are hereby corrected as shown below:

Column 1, line 4: Before the "SUMMARY OF THE INVENTION" insert the following heading and paragraph --DESCRIPTION OF PRIOR ART Carbon monoxide monitor units like that employed in the embodiment of the invention disclosed in detail are available to the trade. These units have a cell which receives a sample of the air supplied, including a meter which indicates the percentage of carbon monoxide in the air and an alarm horn and a relay which provides a primary alarm signal when the percentage of carbon monoxide in the air exceeds a predetermined minimum. Alarm light and bell systems which have a main alarm light, a normally on power light, a test alarm light and an alarm bell, along with a test switch are also available to the trade.--.

CERTIFICATE OF CORRECTION

Patent No. 4,067,004 Dated January 3, 1978

Inventor(s) WILLIAM GULBRANTSON

It is certified that error appears in the above-identified patent and that said Letters Patent are hereby corrected as shown below:

Column 3, line 60: change "AC-L1" (second occurrence) to --AC-L2--.

Column 4, line 10: change "old" to --hold--.

Column 5, line 29: before "The" delete "CO 2 and CO 3";

line 46: after "CO-2" insert --and CO-3--.

Column 7, line 25: change "in between" to --inbetween--.

Column 8, line 4: delete "now" and insert --not--.

Column 9, line 14: before "LA" insert --light--;

line 29: after "line" delete "C" and insert --C3--.

Column 12, line 36: after "I-B" insert a period.

Column 16, line 14: change "reset" to --sent--.

Signed and Sealed this

*Fourth* Day of *December 1979*

[SEAL]

*Attest:*

SIDNEY A. DIAMOND

*Attesting Officer*

*Commissioner of Patents and Trademarks*